United States Patent [19]

Ekhoff

[11] Patent Number: 4,671,018

[45] Date of Patent: Jun. 9, 1987

[54] RIGID DISK FINISHING APPARATUS

[76] Inventor: Donald L. Ekhoff, 14137 Hidden Spring Ln., Morgan Hill, Calif. 95037

[21] Appl. No.: 798,589

[22] Filed: Nov. 15, 1985

[51] Int. Cl.[4] ..... B24B 21/02; B24B 5/00; B24B 21/00; B24B 21/18

[52] U.S. Cl. ..... 51/145 T; 51/103 WH; 51/140; 51/237 T; 51/262 T; 51/262 A

[58] Field of Search ..... 51/140, 141, 145 R, 51/145 T, 237 T, 154, 155, 236, 237 M, 135 R, 262 T, 262 A, 104

[56] References Cited

U.S. PATENT DOCUMENTS

| | | | |
|---|---|---|---|
| 4,038,785 | 8/1977 | Scott | 51/145 R |
| 4,347,689 | 9/1982 | Hammond | 51/145 R X |
| 4,532,665 | 8/1985 | Evans et al. | 51/104 X |

*Primary Examiner*—Frederick R. Schmidt
*Assistant Examiner*—Maurina Rachuba

[57] ABSTRACT

A rigid disk finishing apparatus characterized by an eccentric spindle of small diameter engaging the inner circumference of a rigid disk; a drive mechanism engaging the outer circumference of the rigid disk to rotate the disk around an axis parallel to but not coaxial with the spindle; and a finishing mechanism which extends fully between the inner circumference and the outer circumference of the rigid disk. A transport mechanism is provided to move an unfinished rigid disk to a finishing station for processing, and to remove a finished disk from the finishing station. The finishing mechanism includes an elongated, abrasive or cleaning tape which can be looped against itself to remove large particles prior to its contact with the rigid disk.

24 Claims, 14 Drawing Figures

18
196
206
202
208
32
204
16
210
214
220
226
216
198
218
38
36
34
194
7c 38
16
222
204
196'
214
210
226
218
36
18
216
198
32
196
206
34
194
208
202
7c 200
198
212
226
192
210
206
224
204
196
18
194
202

38
204
214
210
16
220

196
226
218
18
194
202
206
216
198
36
32
208
34

FIG. 8.
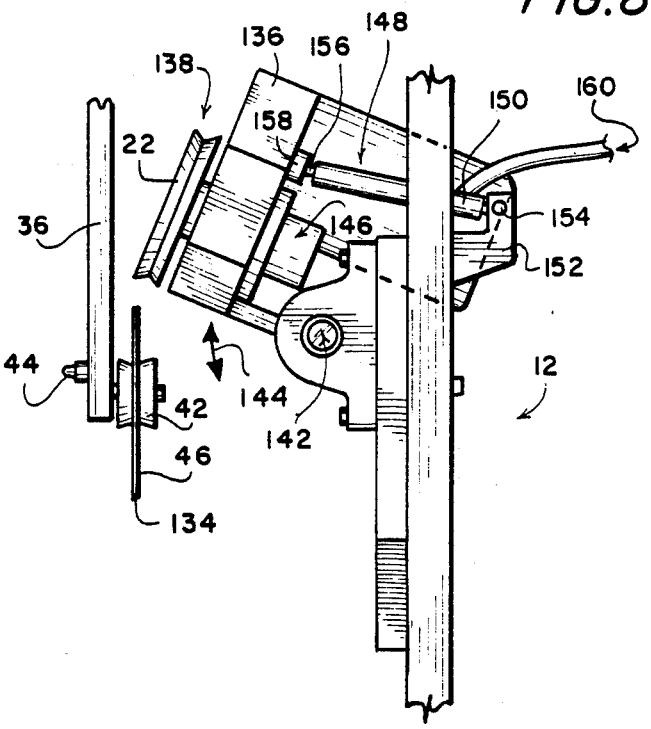
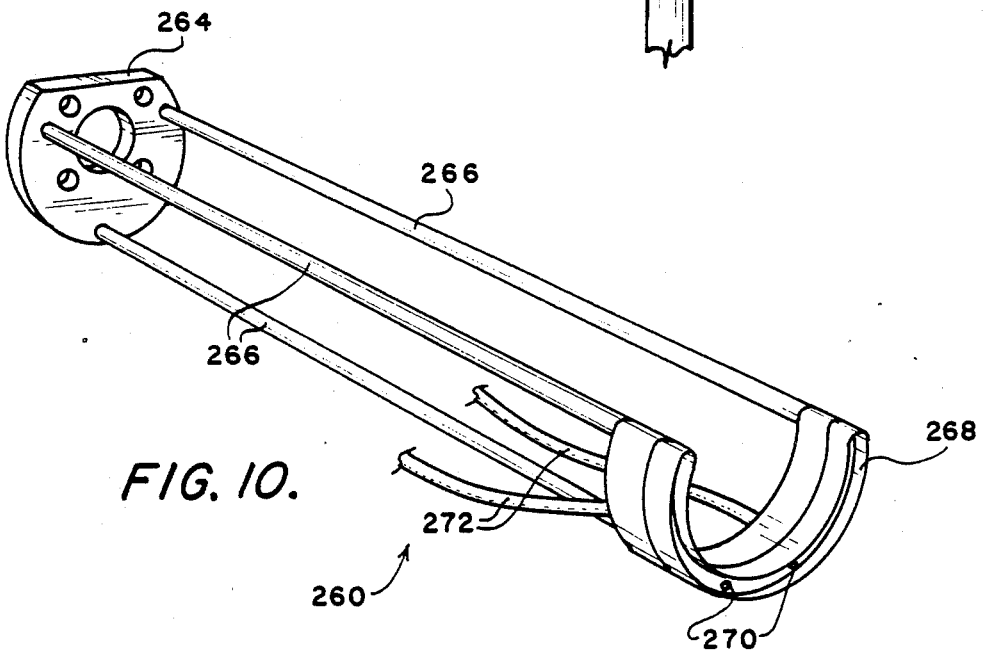
FIG. 10.

RIGID DISK FINISHING APPARATUS

BACKGROUND OF THE INVENTION

1. Field of the Invention

This invention relates generally to abrasive finishing machines, and more particularly to apparatus for polishing rigid disks capable of magnetically storing digital data.

2. Description of the Prior Art

Winchester disk drives include a flat, annular, rigid disk coated with a magnetic material, and a magnetic head assembly which encodes and decodes digital information in the magnetic material of the disk. The disk and head assembly are enclosed within an air-tight enclosure, and the disk is rotated rapidly around its axis by an electric motor. The head assembly moves radially across the surface of the disk between various recording tracks in the magnetic material.

The trend in the industry is to pack ever greater amounts of data onto a single rigid disk, which implies increasing the bit density on the disks. A disk's bit density is inversely proportional to the size of the magnetic domains that stores an individual bit. In other words, as the magnetic domains decrease in size, the bit density of the disk increases. To decrease the size of a magnetic domain the magnetic layer should be as thin as possible, and the distance between the head assembly and the magnetic material should be minimized.

As the separation between the head and the disk decreases, the chance of a disk head "crash" increases. In a head crash, the head assembly scrapes the surface of the magnetic layer, destroying the data stored on the disk. To minimize the chance of a head crash, the environment within the Winchester enclosure is made as free as possible of particulate matter, and the magnetic layer is made as smooth as possible.

A necessary prerequisite to a smooth magnetic surface is a smooth, polished surface on an uncoated rigid disk. While a number of materials, including plastic, have been used as base materials for a rigid disk, virtually all rigid disks in present day use are made from aluminum. Thus, the problem faced by the industry was to develop rigid disk finishing machinery capable of producing a smooth finish on an aluminum disk.

The rigid disk finishing machines of the prior art typically include a spindle which clamps to the inner circumference of a rigid disk, a motor for rotating the disk, and an abrasive member which moves radially back and forth across the surface of a disk. Typically, these machines are not highly automated, and process only a single disk at a time.

The disk finishers of the prior art have several noticeable disadvantages. Firstly, since the spindle is clamped to the disk the surface of the disk surrounding the inner circumference is often damaged. Secondly, and again due to the clamping of the spindle to the disk, the disk cannot be polished fully from its outside circumference to its inside circumference. This, of course, reduces the useful surface area of the disk. Finally, the movement of the abrasive member radially across the rotating dish can produce small, spiral grooves in the surface of the disk, which can affect the ultimate performance of the disk drive unit.

Some rigid disk finishing machines utilize an abrasive strip which is moved across the surface of the disk. A problem with abrasive strips is that an occasional large, abrasive particle embedded in the surface of the strip can damage or ruin a disk. The prior art does not disclose a simple, effective way of removing large particles of abrasive from an abrasive strip.

SUMMARY OF THE INVENTION

An object of this invention is to provide a rigid disk finishing apparatus capable of abrasively finishing an annular, rigid disk fully and simultaneously from its inner circumference to its outer circumference.

Another object of this invention is to provide a rigid disk finishing apparatus which does not produce spiral grooves on the surface of a disk.

Yet another object of this invention is to provide a finishing mechanism which removes large abrasive particles from an abrasive strip prior to its contact with a surface of a rigid disk.

Briefly, the invention comprises an eccentric spindle having a diameter smaller than the internal diameter of the rigid disk, and a pair of drive sheaves which contact the outer circumference of the rigid disk. The sheaves are caused to rotate, which rotates the disk around an axis which is parallel to, but not coaxial, with the eccentric spindle. A finishing strip is urged against a radial section of the disk as it rotates to contact the disk fully between its inner circumference and its outer circumference. The finishing strip may be abrasive, or it may be a soft cleaning strip.

Due to the fact that the eccentric spindle is smaller in diameter than the inner diameter of the rigid disk the entire surface of the disk may be finished in a uniform manner by the finishing strip. The stability problems of such an arrangement are solved by supporting the disk along three points in a common plane.

In order to automate the processing of the disks, a multi-armed mechanism is provided to move the rigid disks sequentially through a finishing station. An indexing mechanism is disclosed which accurately positions the disks within the finishing station.

The present invention also teaches a finishing mechanism including an elongated, abrasive strip, which is looped back against itself to dress the abrasive surface prior to its contact with a rigid disk. By dressing the abrasive strip, large particles of abrasive can be removed, minimizing the chance of damaging the disk.

An advantage of the present invention is that a rigid disk can be finished or cleaned across its entire surface, and without damage caused by the clamping spindles of the prior art.

Another advantage of this invention is that it finishes a rigid disk without producing spiral grooves in its finish.

Yet another advantage of this invention is that rigid disks may be finished more quickly than was possible with devices of similar function in the prior art.

A still further advantage of this invention is that the abrasive strip is dressed prior to use, reducing the frequency of damage to the finished disks.

These and other objects and advantages of the present invention will no doubt become apparent upon a reading of the following descriptions and a study of the several figures of the drawing.

BRIEF DESCRIPTION OF THE DRAWING

FIG. 8 is a detail view of the disk drive retraction mechanism;

FIG. 10 a perspective view of a vacuum pick-up arm used in the alternate embodiment of FIG. 9.

DETAILED DESCRIPTION OF THE PREFERRED EMBODIMENT(S)

Figure 1:
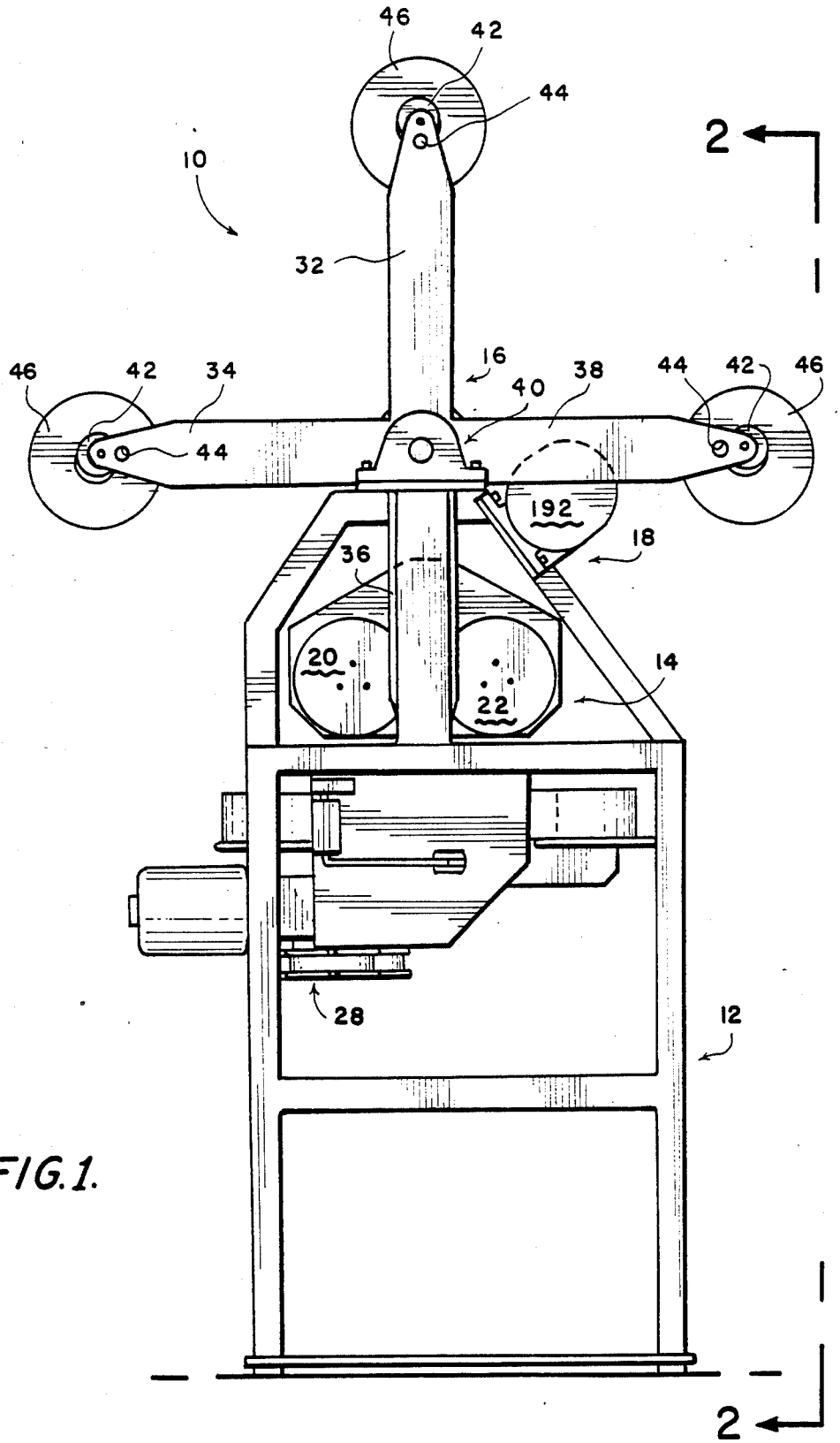
FIG. 1 is a front elevation of a rigid disk finishing apparatus in accordance with the present invention.
Figure 2:
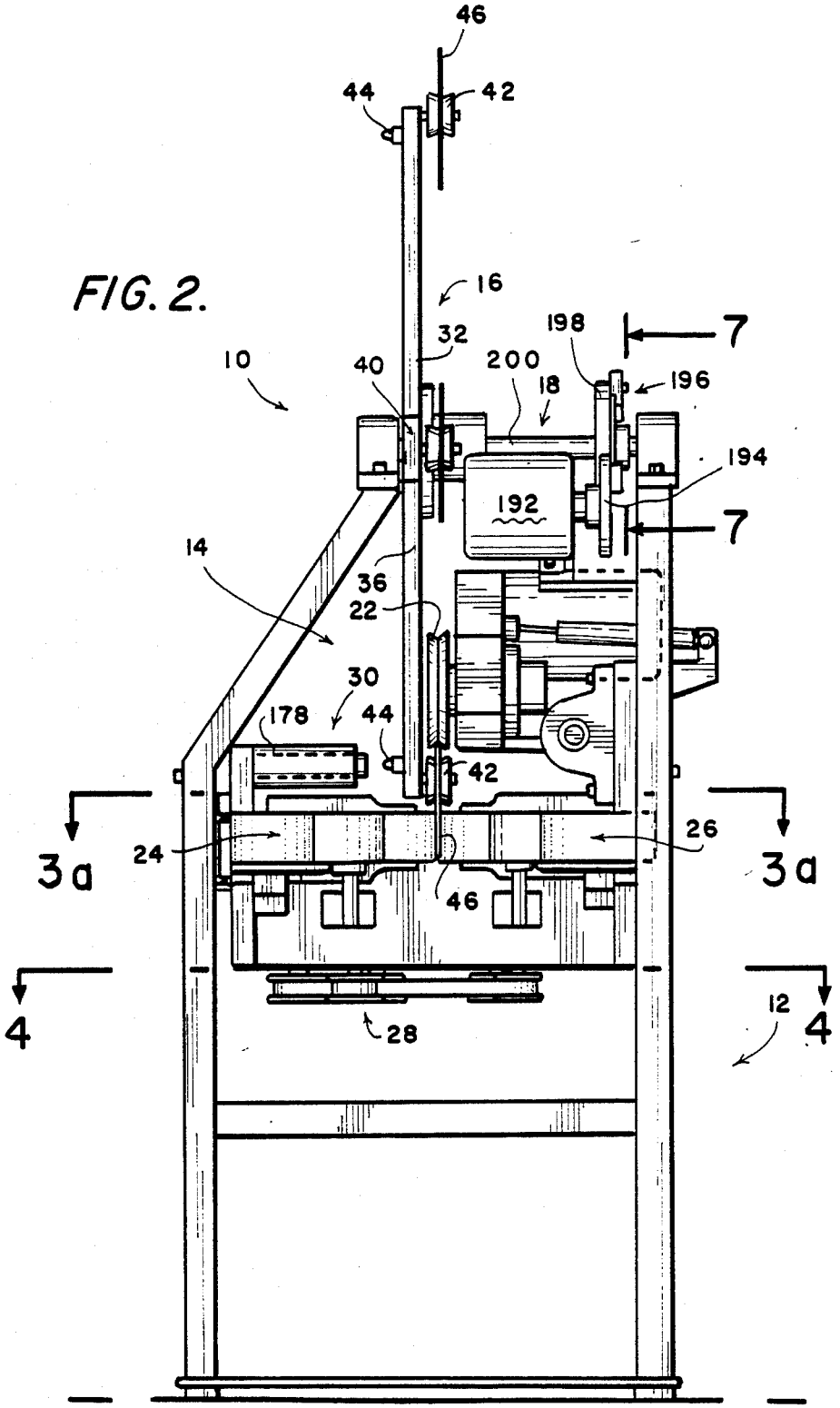
FIG. 2 is a side elevation taken along line 2—2 of FIG. 1.

Referring initially to FIGS. 1 and 2, a hard disk finishing apparatus 10 in accordance with the present invention includes a frame 12, a finishing station 14, a multi-armed transport device 16, and an indexing mechanism 18. Frame 12 rigidly supports the remainder of the apparatus, and is preferably made from a light, strong material such as tubular steel. The details of construction of the frame are unimportant once it is understood that its function is to rigidly and securely support the remainder of the apparatus above ground level.

Finishing station 14 includes a pair of disk drive sheaves 20 and 22, a pair of strip assemblies 24 and 26, a strip drive mechanism 28, and an arm locking mechanism 30. A more detailed description of finishing station 14 will discussed with reference to subsequent figures.

Transport device 16 includes a number of arms 32, 34, 36, and 38 attached at a central hub 40. Each of arms 32–38 is provided with an eccentric spindle 42 and a lubrication stud 44. An annular, rigid disk referenced generally as 46 is supported by its inner circumference by one of the eccentric spindles 42.

Figure 3A:
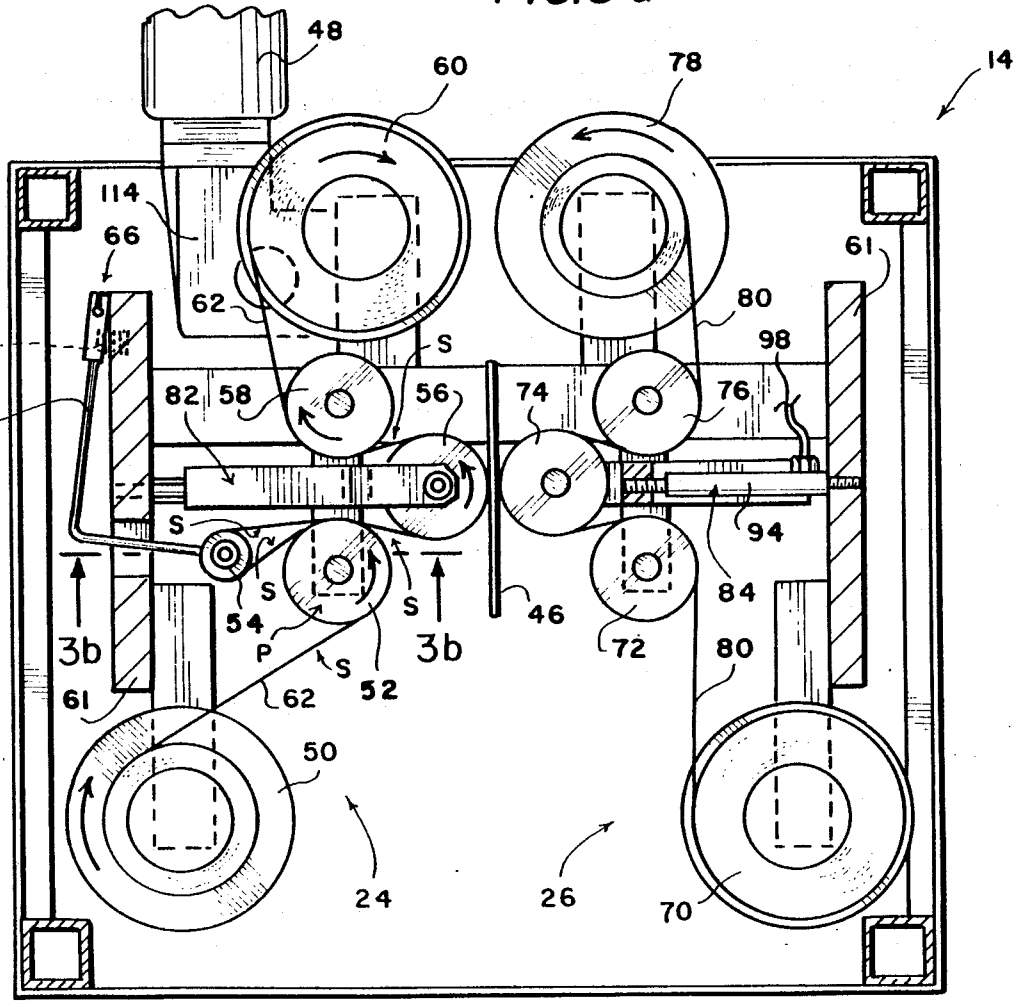
FIG. 3*a* is a cross section taken along line 3*a*—3*a* of FIG. 2.

Referring now to FIG. 3*a*, the finishing station 14 will be discussed in greater detail. The rigid disk 46 is shown in an end view to be lodged between strip assemblies 24 and 26. The strip assemblies 24 and 26 are shown here in two different embodiments, it being understood that either embodiment could be used on either or both sides of the finishing station 14. If an abrasive strip is used, the strip assembly 24 has the advantage of dressing the abrasive strip prior to its contact with rigid disk 46. If a soft, cleaning strip is used the mechanism of strip assembly 26 can be utilized.

Strip assemblies 24 and 26 are powered by a common electric motor 48 via a strip drive mechanism 28 (see FIGS. 1 and 2). The drive mechanism 28 will be discussed later in greater detail with reference to FIG. 4.

Still referring to FIG. 3*a*, the strip assembly 24 includes a source reel 50, a idler roller 52, a tensioning roller 54, a pinch roller 56, a drive roller 58, and a take-up reel 60. Reels 50 and 60 and rollers 52–58 are supported by a frame designated generally a 61.

Source reel 50 includes a supply of abrasive finishing tape 62, which is a long, narrow strip of flexible material. Tape 62 is trained around rollers 52–58 in succession, and then engages take-up reel 60.

Finishing tape 62 is provided with abrasive on a surface S. It is this abrasive covered surface S which ultimately contacts the rigid disk 46. As mentioned previously, a problem encountered in the prior art is that the particles of abrasive on a surface S would occasionally include a large abrasive particle which might damage the surface of a disk 46. To reduce this problem, the finishing tape 62 is looped back on itself by the tensioning roller 54 such that it rubs against itself at a point P on idler roller 52.

Tensioning roller 54 is supported by an L shaped arm 64 which is hinged to frame 61 at an end 66. A spring 68 biases L shaped arm 64 away from frame 61 to provide tension to the loop of finishing tape 62 engaged with tensioning roller 54.

Thus, the tape 62 is drawn from source reel 50 to take-up reel 60, the surface S to which the abrasive material has been applied rubs against itself at a point P on idler roller 52. This action "dresses" the finishing tape 62, and removes large particulate matter from surface S prior to its application to rigid disk 46.

Strip assembly 26 is of similar construction to strip assembly 24, except that the self dressing mechanism is not present. In applications where the finishing tape is not abrasive (i.e. a cleaning tape), or where the surface finish on rigid disk 46 is not quite as critical, the self dressing mechanism can be eliminated to lower system costs.

More specifically, strip assembly 26 includes a source reel 70, an idler roller 72, a pinch roller 74, a drive roller 76, and a take-up reel 78. Reels 70 and 78 and rollers 72–74 are supported by frame 61. A finishing tape 80 is trained around rollers 72–76 and moves from source reel 70 to take-up reel 78.

Pinch rollers 56 and 74 are supported by actuating assemblies 82 and 84, respectively. Actuating assemblies 82 and 84 are of similar construction, and like numerals will refer to like components in both. The actuating assembly 84 is shown partially broken away to illustrate some of the components of the device.

Figure 3B:
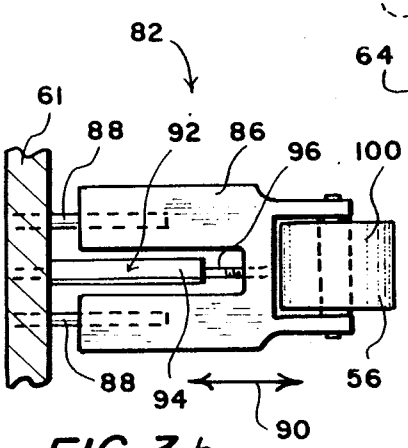
FIG. 3*b* is a cross section taken along line 3*b*—3*b* of FIG. 3*a*.

Referring now to FIG. 3*b*, actuating assembly 82 includes a carriage 86 guided by a pair of guide rails 88 which are attached to frame 61. Carriage 86 may move back and forth as indicated by arrow 90 under the control of a pneumatic cylinder 92. The pneumatic cylinder 92 includes a housing 94 attached to frame 61 and a shaft 96 attached to carriage 86. When pneumatically actuated via an air line 98, the carriage 86 is caused to move to the right to contact rigid disk 46. The deactivation of pneumatic cylinder 92 causes the carriage to move to the left, retracting pinch roller 56 from rigid disk 46. The pinch roller 56 is rotatably supported on carriage 86 by an axle 100.

Actuating assemblies 82 and 84 are provided to permit the loading and unloading of a rigid disk 46 from finishing station 14. More specifically, actuating assemblies 82 and 84 retract pinch rollers 56 and 74 from rigid disk 46 to allow disk 46 to move into or out of the position shown in FIG. 3*a*. When a rigid disk 46 is ready for finishing, the actuating assemblies 82 and 84 are activated to cause pinch rollers 56 and 74 to move towards rigid disk 46, forcing finishing tape 62 against one side of the disk, and finishing tape 80 against the other side of the disk. In this manner, both sides of the disk are finished simultaneously.

Referring now to the bottom plan view of FIG. 4, the drive mechanism for take-up reels 60 and 78 will be discussed in greater detail. The take-up reels 60 and 78 are coupled through the base of frame 61 to pulleys 102 and 104, respectively, by shafts 106 and 108, respectively. Motor 48 is coupled to a drive pulley 110 by a shaft 112 from a right angle drive 114 (see briefly FIG. 3*a*). Drive roller 58 is coupled to a pulley 116 by a shaft 118, and drive roller 76 is coupled to a pulley 120 by a shaft 122. An idler pulley 124 is coupled to frame 61 by a shaft 126.

Pulleys 102, 104, 110, 116, 120, and 124 are coupled together by a double sided cog belt 128. Belt 128 is cogged to minimize belt slippage, and is double sided to permit the pulleys to be driven in either a clockwise or counterclockwise direction. From the view of FIG. 4, the pulleys 102 and 116 are driven in a clockwise direction, and pulleys 104, 110, 124, and 120 are rotated in a counterclockwise direction.

Figure 4:
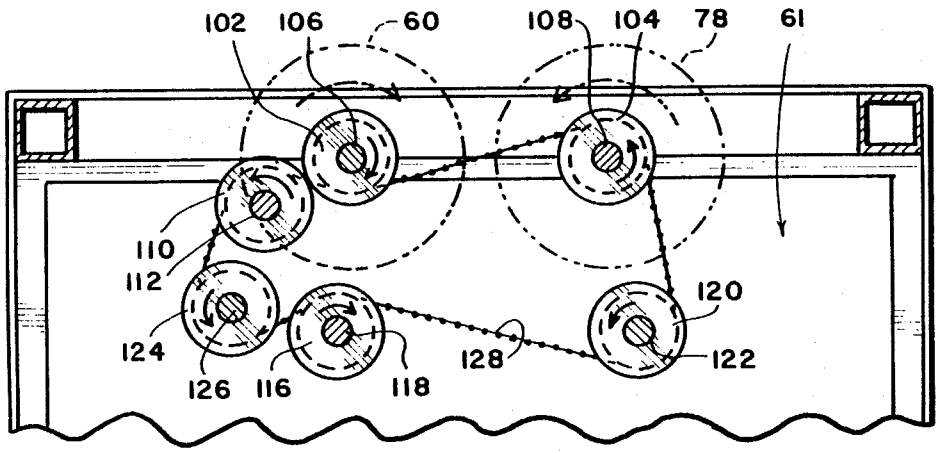
FIG. 4 is a cross section taken along line 4—4 of FIG. 2.

Referring now to FIGS. 3*a* and 4, it can be seen that finishing tape 62 is drawn through the system by the rotation of drive roller 58 and take-up reel 60. Drive roller 58 assists the movement of finishing tape 62 to minimize the stress exerted on take-up reel 60 and on the used finishing tape. Similarly, finishing tape 80 is drawn through the system by drive roller 76 and take-up reel 78.

Figure 6:
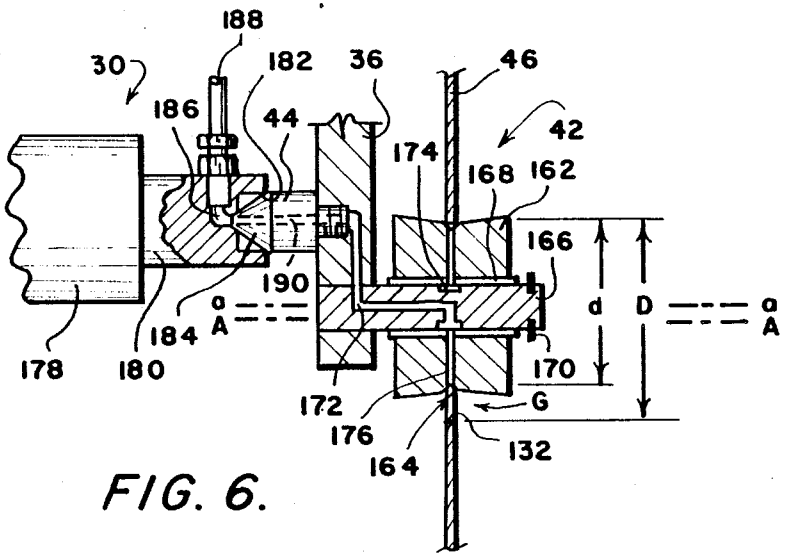
FIG. 6 is a cross section taken along line 6—6 of FIG. 5.
Figure 5:
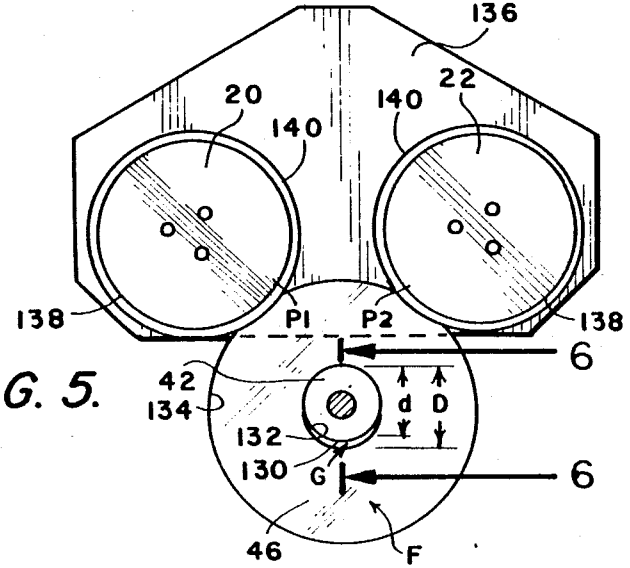
FIG. 5 is a detail view of the disk drive mechanism of the present invention.

Referring now to FIGS. 5 and 6, a rigid disk 46 is shown supported on an eccentric spindle 42. It can be seen in both FIGS. 5 and 6 that a diameter d of spindle 42 is less than a diameter D of the center hole 130 of disk 46. Because the diameter d of the eccentric spindle 42 is less than the internal diameter D of hole 130, a gap G is created between the eccentric spindle 42 and the inner circumference 132 of rigid disk 46. It is this gap G which allows the finishing strips 62 and 80 to contact finishing surfaces F fully between the inner circumference 132 and the outer circumference 134 of rigid disk 46.

Because the finishing tapes 62 and 80 contact the finishing surfaces F fully between the inner circumference 132 and the outer circumference 134, the entire surface of the disk 46 may be finished in a complete, predictable, and consistent manner. Furthermore, since the finishing strips 80 and 62 do not move radially respective to disk 46, they do not cut spiral grooves into the surface of the disk. If any grooves are cut into the surface of disk 46, they will be in the less damaging form of concentric grooves.

Referring more specifically to FIGS. 5 and 8, the disk drive sheaves 20 and 22 are supported for rotation by a frame 136. Each of drive sheaves 20 and 22 have a V-shaped groove 138 cut into its circumference which is adapted to contact the outer circumference 134 of a rigid disk 46. Preferably, an outer circumferential portion 140 of drive sheaves 20 and 22 are made from a flexible, plastic material to increase friction between the drive sheaves 20/22 and rigid disk 46. As seen in FIG. 5, the V-grooves 138 of outer portions 140 engage the outer circumference 134 of rigid disk 46 at points P1 and P2.

By simultaneously rotating sheaves 20 an 22 in a first direction, the disk 46 is caused to rotate in an opposing direction. Much of the weight of disk 46 is supported by spindle 42, but the planar stability of the rotating disk 46 is ensured by the three-point contacts at P1, P2, and F. In other words, drive sheaves 20 and 22 stabilize an upper edge of disk 46 at points P1 and P2, while pinch rollers 56 and 74 stabilize a lower surface of rigid disk 46 at finishing surfaces F. Because of this three-point support system, the rigid disk 46 can be rapidly rotated in a fixed, stable plane.

Referring now more specifically to FIG. 8, the frame 136 is supported by a pivot assembly 142 such that it can pivot as indicated by arrow 144 between a loaded and unloaded position. Also seen in this figure is a motor assembly 146 which rotates sheave 22. Sheave 20 is either rotated by a motor similar to motor 146, or it is rotated by the motor 146 via a drive belt, drive chain, gears, etc.

A pneumatic cylinder assembly 148 is coupled between frame 12 and frame 36 to move the sheaves 20/22 between their loaded and unloaded positions. More specifically, a cylinder 150 is attached to an extension 152 of frame 12 by a pivot 154, and a shaft 156 which extends from cylinder 150 is coupled to a plate 158 of frame 136. Activating pneumatic cylinder assembly 148 via a pneumatic hose 160 causes shaft 156 to extend from or retract into cylinder 150, moving the frame 136 to unload or load sheaves 20/22.

Referring now to FIG. 6, the eccentric spindle 42 includes a substantially cylindrical body 162 having a V-shaped groove 164 circumferentially cut into its surface. V-shaped groove 164 engages the inner circumference 132 of a rigid disk 46. The body 162 of eccentric spindle 42 is supported on a shaft 166 by a roller bearing 168. Body 162 of spindle 42 is free to rotate around an axis a. The disk 46. on the other hand, rotates around its own axis A which is parallel to, but not coaxial with the axis a of spindle 42.

Shaft 166 is supported on arm 36 of transport device 16, and has a retainer clip 170 to ensure that spindle 142 stays on shaft 166. The shaft 166 and arm 36 are provided with a lubrication passage 172 which couples lubrication stud 44 to an orifice 174 of shaft 166. Orifice 174 is aligned with lubrication passages 176 in body 162 of spindle 42 such that lubrication fluid can be continuously released from V-shaped groove 164. Since the inner circumference 132 of rigid disk 46 engages V-shaped groove 164 near the top and sides of spindle 42, a majority of the fluid will be ejected at V-shaped portion 164 near gap G. Lubricating fluid will flow down both sides of disk 46 near the finishing surface F where the finishing strips 62 and 80 contact the disk 46.

Referring now to FIGS. 2 and 6, the arm locking mechanism 30 includes a pneumatic cylinder 178 and a shaft 180 which can be extended from or retracted into cylinder 178 under pneumatic control. The end of shaft of 180 is provided with a conical recess 182 which is adapted to engage the truncated, conical end 184 of lubrication stud 44. When the end of shaft 180 is engaged with lubrication stud 44, the arm 36 is locked into position.

Conical recess 182 is coupled by a passage 186 to a lubrication hose 188. Lubrication hose 188 is coupled to a lubrication reservoir by hydraulic pump (not shown). When activated, lubrication flows, under pressure, through hose 188, passage 186, into a passage 190 of lubrication stud 44, through passage 172 and 176, and onto the rigid disk 46.

Referring now to FIGS. 2 and 7*a*–7*d*, the indexing mechanism 18 of the present invention includes a motor 192, a flywheel 194, an indexing arm 196, and an indexing plate 198 coupled to central hub 40 by a shaft 200. The arms 32–38 of transport device 16 can be seen in the background.

Indexing arm 196 includes a first end portion 202, a second end portion 204, and a flexible center portion 206. First end portion 202 is coupled to the surface of flywheel 194 by a pivot pin 208. Second end portion 204 is provided with a pawl 210 having an angularly truncated surface 212 (see FIG. 7*c*). The pawl 210 is adapted to engage holes 214–220 provided in indexing plate 198.

Figure 7A:
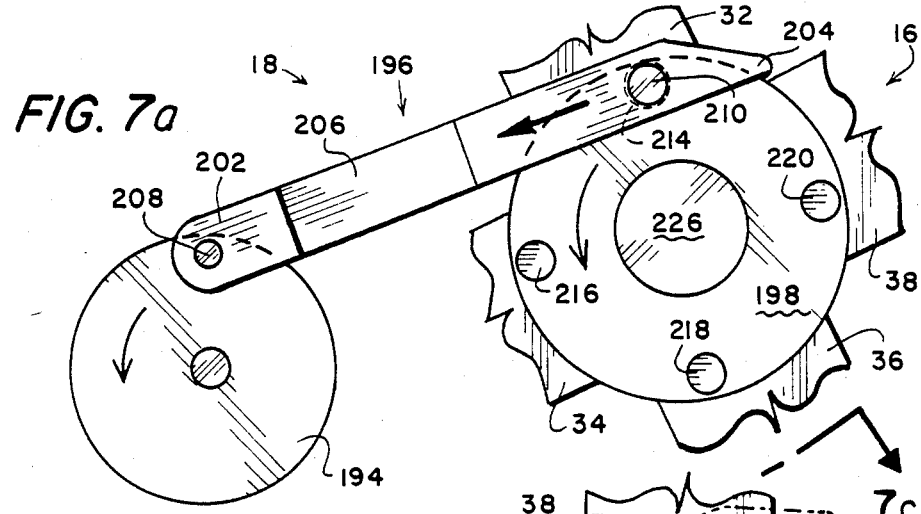
FIGS. 7*a*–7*d* are detailed views of the arm indexing mechanism of the present invention taken generally from 7—7 of FIG. 2.

Referring to FIG. 7*a*, the indexing mechanism 18 is in the process of rotating the transport device 18 through an arc of 90°. In other words, the arm 36 as shown in FIGS. 1, 2, 6, and 8 is being rotated out of the finishing station 14, and arm 34 is being rotated into the finishing station 14. As flywheel 194 rotates, the indexing plate 198 is caused to rotate due to the engagement of pawl 210 with hole 214. This, of course, rotates central hub 40 due to connecting shaft 200.

Figure 7B:
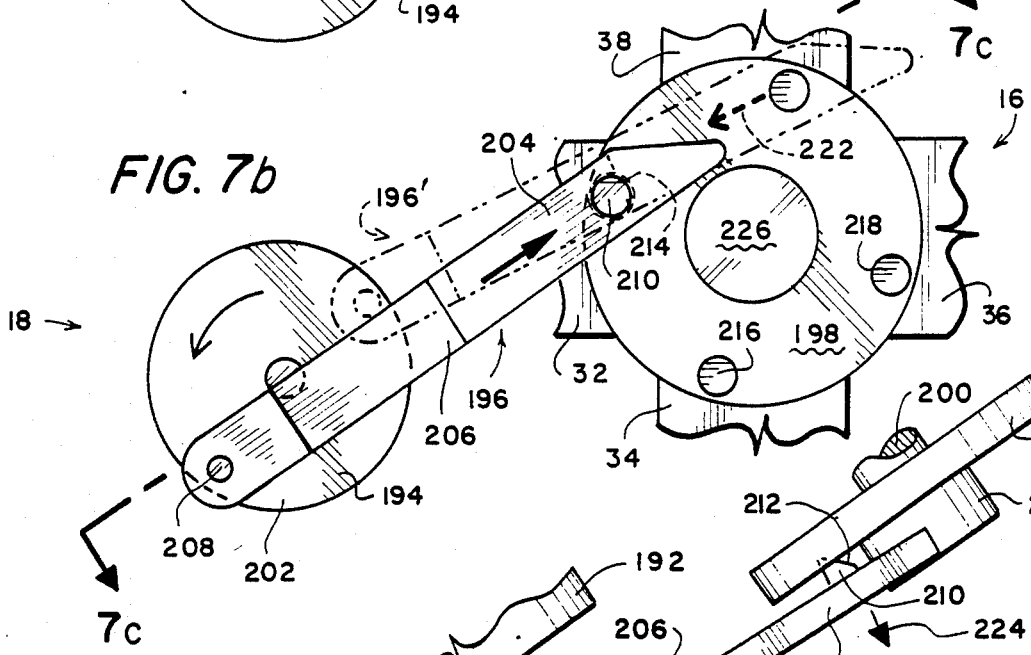

In FIG. 7*b*, the original position of indexing arm 196 is shown in broken line at 196'. The indexing arm 196 has caused the arm 32 to rotate 90° from its original vertical position to a horizontal position. When in this position, arm locking mechanism 30 engages the lubrication stud 44 of arm 34, locking the transport device 16 in position.

Figure 7C:
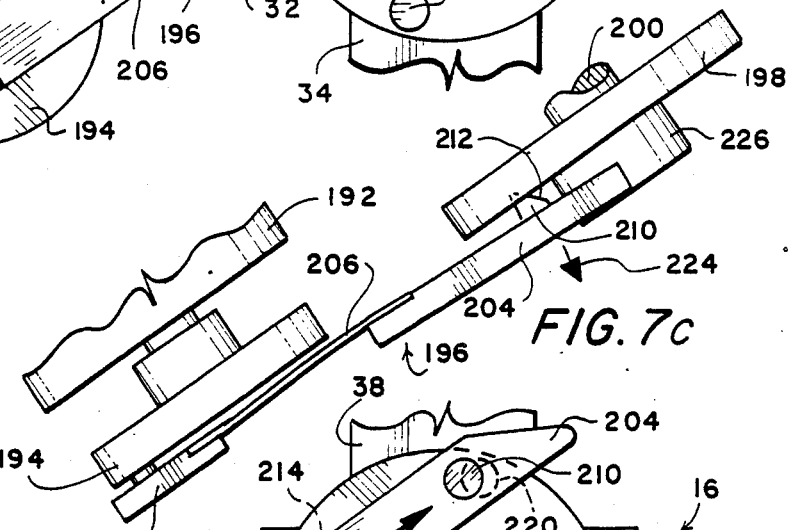

Referring now to both FIGS. 7*b* and 7*c*, with the transport device 16 firmly locked in position pawl 210 disengages itself from hole 214 of indexing plate 198 due to the angled surface 212. Flexible center portion 206 of indexing arm 196 permits second end portion 204 of indexing arm 196 to flex away from indexing plate 198 as indicated by the arrow 224 in FIG. 7*c*.

Figure 7D:
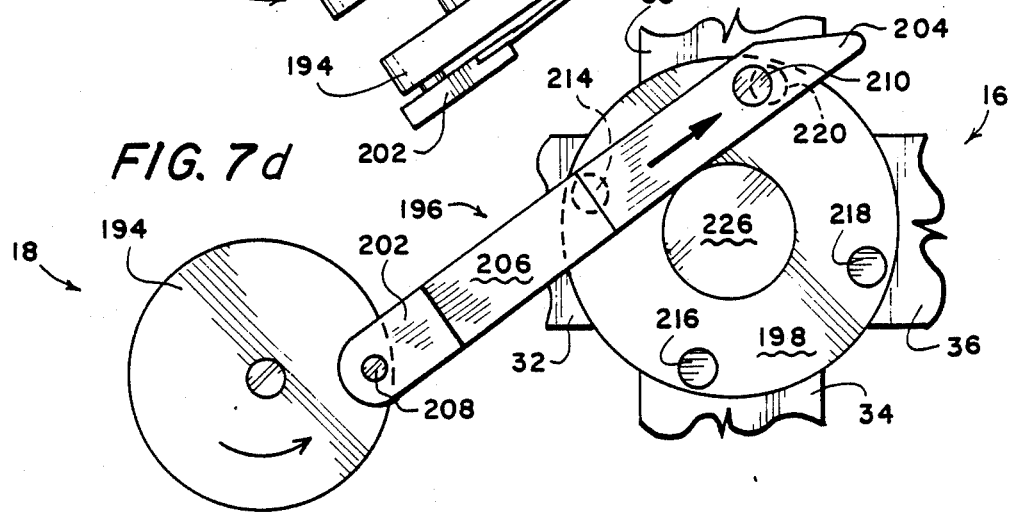

Referring to FIG. 7*d*, as flywheel 194 continues to rotate, pawl 210 slides along the surface of indexing plate 198 to engage hole 220. The rotation of flywheel 194 is then halted until the next indexing action of transport device 16 is initiated. The pawl 210 is guided back to pole 220 due to the sliding contact between second end portion 204 of indexing arm 196 with a cylindrical guide 226 coaxially attached to indexing plate 198.

Figure 9:
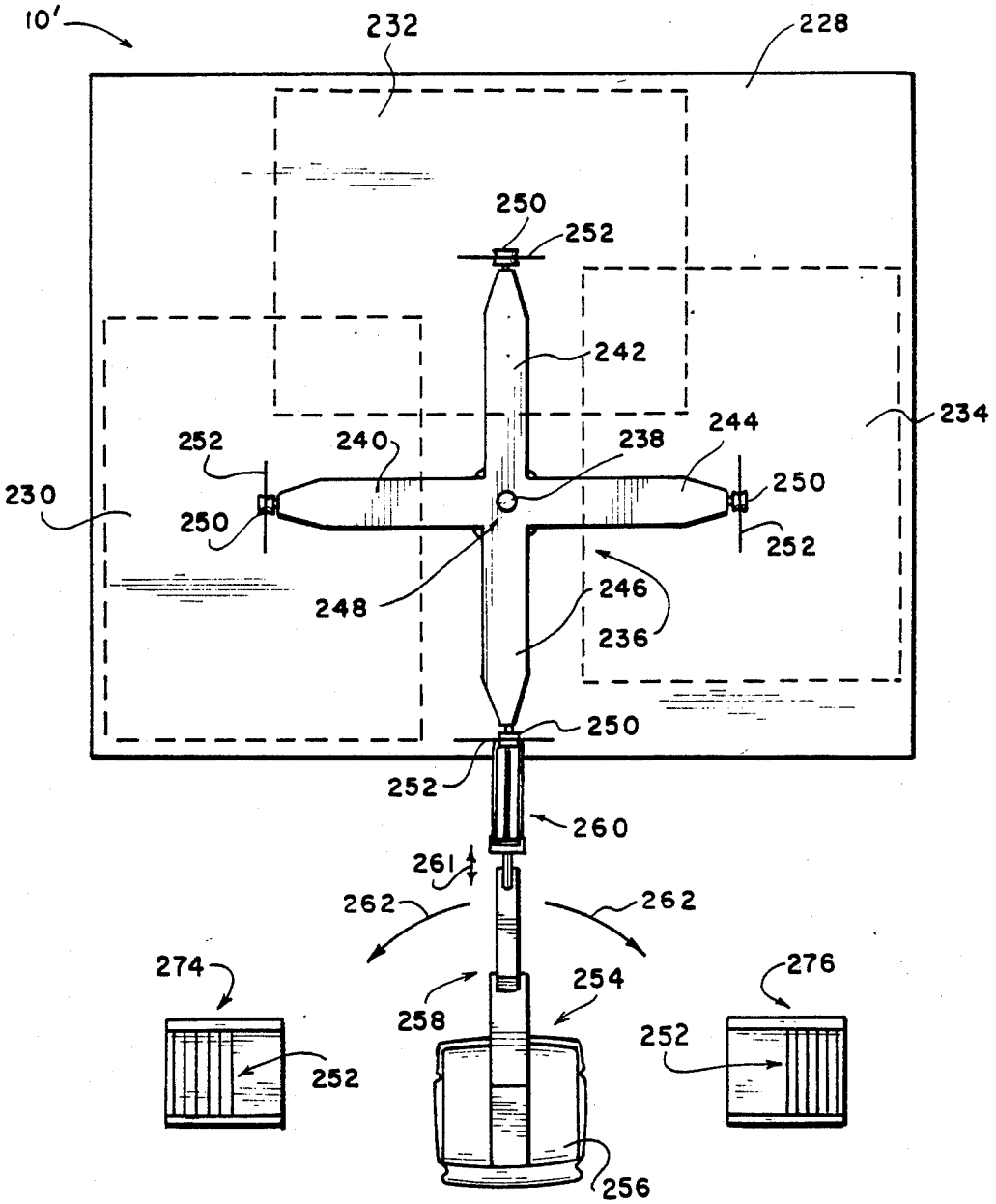
FIG. 9 is a schematic-type representation of an automated alternate embodiment of the present invention.

Referring now to FIG. 9, an alternate embodiment of the present invention is a hard disk finishing apparatus 10', including a frame 228 and three finishing stations 230, 232, and 234. The apparatus 10' is being viewed from a top plan view to show a multi-armed transport device 236 which rotates around a vertical shaft 238. This is in contrast to the apparatus 10 of FIGS. 1–8 which has a multi-armed transport device 16 which rotates around a horizontal shaft.

Transport device 236 includes a number of arms 240–246 equally spaced around a central hub portion 248. Each of arms 240–246 are provided with an eccentric spindle 250 which can engage a rigid disk 252 in a similar fashion to the engagement of spindle 42 with rigid disk 46 in the embodiments of FIGS. 1–8.

A robotic arm assembly 254 includes a base unit 256, a radially extensible arm 258, and a gripper assembly 260. Arm 258 is capable of linear motion as indicated by arrow 261 and is also capable of moving in a horizontal arc as indicated by arrows 262.

Gripper assembly 260 includes a plate which attaches to the end of arm unit 258, a number of posts 266 cantilevered from plate 264, and a vacuum actuated disk engagement member 268. Disk engagement member 268 is provided with a plurality of vacuum holes 270 which are coupled to a vacuum source by vacuum lines 272.

Referring now to both FIGS. 9 and 10, in operation the arm unit 258 of robotic arm assembly 254 is rotated to pick a rigid disk 250 from a cassette 274. The arm unit 258 is then rotated 90° and extended to place a rigid disk 252 on a spindle 250 of arm 246. The gripper assembly 260 is then is deactivated and the arm unit 258 is retracted.

To remove a rigid disk 252 from an arm in the position shown in 246, the arm unit 258 is extended and the gripper assembly 260 is activated to grip the rigid disk 252. The arm unit 258 is then retracted and rotated to place the rigid disk 252 within a second cassette 276.

By providing a plurality of finishing stations 230–234, the finishing of the rigid disks 252 may be accomplished in stages. For example, a coarse finish process may occur a first station 230, a fine finish process may occur in second station 232, and a wash process can occur at third station 234 to remove any particulate matter from the rigid disks 252.

By utilizing the robotic version of the present invention illustrated in FIGS. 9 and 10, rigid disks 252 may be rapidly and automatically finished. The only human action necessary would be the need for someone to load cassettes 274 of unfinished disks and to remove cassettes 276 of finished disks.

While this invention has been described in terms of a few preferred embodiments, it is contemplated that persons reading the preceding descriptions and studying the drawing will realize various alterations, permutations and modifications thereof. It is therefore intended that the following appended claims be interpreted as including all such alterations, permutations and modifications as fall within the true spirit and scope of the present invention.

What is claimed is:

1. A rigid disk finishing apparatus used to process a flat, annular, rigid disk having an inner diameter and an outer diameter and opposing first and second sides, said apparatus comprising:

spindle means having a spindle axis, said spindle means having a substantially cylindrical configuration around said spindle axis and having a maximum perpendicular dimension relative said spindle axis which is less than said inner diameter of said rigid disk; said spindle means being oriented eccentrically within the inner diameter of said rigid disk;

sheave drive means contacting an outer circumference of said rigid disk to form a gap between said rigid disk and a portion of said cylindrical spindle means opposite said sheave drive means when an inner circumference of said rigid disk is supported by said spindle means, said sheave drive means being operative to rotate said rigid disk around a disk axis which is parallel to said spindle axis, said disk axis and said spindle axis saced apart by a distance equal to said gap; and first side finishing means selectively engaging segment of said first side of said rigid disk, said first side finishing means having opposed first and second edges, said first edge disposed within said gap formed between the spindle means and the inner circumference of said rigid disk, said first side finishing means traversing said rigid disk in a direction perpendicular to said disk axis and providing a substantially uniform force across said segment.

2. A rigid disk finishing apparatus as recited in claim 1 wherein said spindle means is free to rotate around said spindle axis.

3. A rigid disk finishing apparatus as recited in claim 2 wherein said spindle means is provided with a lubrication channel which can be coupled to a source of lubrication, said lubrication channel having an outlet orifice adapted to spray lubrication on said rigid disk from a position within said inner diameter of said rigid disk.

4. A rigid disk finishing apparatus as recited in claim 1 wherein said drive means includes a drive sheave contacting said outer circumference of said rigid disk.

5. A rigid disk finishing apparatus as recited in claim 4 wherein said drive sheave is a first drive sheave, and further comprising a second drive sheave contacting said outer circumference of said rigid disk, wherein the axes of rotation of said first drive sheave, said second drive sheave, and said rigid disk are not coplanar.

6. A rigid disk finishing apparatus as recited in claim 5 further comprising drive motor means coupled to said first drive sheave and said second drive sheave such that said first drive sheave and said second drive sheave have substantially the same angular velocity.

7. A rigid disk finishing apparatus as recited in claim 5 further comprising means for moving said first drive sheave and said second drive sheave towards and away from said spindle means.

8. A rigid disk finishing apparatus as recited in claim 1 wherein said first side finishing means includes a strip of flexible material having a width greater than the difference een said outer diameter and said inner diameter of said rigid disk.

9. A rigid disk finishing apparatus as recited in claim 8 further comprising means for selectively pressing a section of said strip against said first surface of said rigid disk.

10. A rigid disk finishing apparatus as recited in claim 8 further comprising means for drawing said strip past said rigid disk.

11. A rigid disk finishing apparatus as recited in claim 10 further comprising means for looping said strip against itself prior to contacting said rigid disk.

12. A rigid disk finishing apparatus as recited in claim 1 further comprising second side finishing means adapted to engage said second surface of said rigid disk, said second side finishing means extending from said outer circumference of said rigid disk to said inner circumference of said rigid disk.

13. A rigid disk finishing apparatus as recited in claim 1 having a plurality of spindles, each capable of eccentrically engaging a portion of an inner circumferences of an annular, rigid disk, where each of said spindles is smaller in diameter than the inner diameters of said rigid disks, said finishing apparatus further having transport means for moving said plurality of spindles consecutively through a plurality of stations, where at least one of said stations includes said sheave drive means adapted to engage a portion of an outer circumference of a disk to cause said disk to rotate, and said finishing means adapted to radially contact a surface of said disk fully between said inner circumference and said outer circumference.

14. A rigid disk finishing apparatus as recited in claim 13 wherein said transport means includes a plurality of arms, of which supports one of said plurality of spindles.

15. A rigid disk finishing apparatus as recited in claim 14 wherein said plurality of arms are radially supported by a central hub, and wherein said transport means further includes indexing means for rotating said hub.

16. A finishing mechanism comprising, a freely rotating spindle having a cylindrical configuration rotatable about a spindle axis, an annular rigid disk having an inner circumference defining a center aperture, said inner circumference fitted about the circumference of said cylindrical spindle, said center aperture having a diameter greater than the diameter of said spindle said rigid disk having opposed first and second surfaces and having an outer circumference, said spindle means being oriented eccentrically within the inner diameter of said rigid disk;

drive means having a pair of sheaves, each sheave including a sheave circumference having a V-shaped groove contacting said outer circumference of the rigid disk to form a gap between said spindle and a portion of said inner circumference of the rigid disk, said drive means powering said pair of sheaves to rotate said rigid disk about a disk axis spaced apart from said spindle axis by a distance equal to said gap, an elongated, flexible strip member having a first side and a second side, said strip member having a finishing material applied to said first side, and having opposed first and second edges, said first edge disposed within said gap and spaced apart from said second edge by a distance greater than the distance between the circumference of the spindle and the outer circumference of the rigid disk, said strip member traversing a segment of the rigid disk perpendicular to said spindle axis, means for drawing said strip member past said segment of the rigid disk, said strip member providing a substantially uniform force across said segment, and means for looping said strip member against itself such that a first portion of said first side is caused to rub against a second portion of said first side prior to contacting said segment of the rigid disk.

17. A finishing mechanism as recited in claim 16 further comprising means for selectively urging said first side of said strip member against said workpiece.

18. A disk fininshing apparatus comprising, a flat, annular, rigid disk having an inner circumfernce defining a center aperture, and outer circumference and opposing first and second sides, cylindrical spindle means having a spindle axis, said spindle means being freely rotatable about said spindle axis and having a maximum perpendicular dimension relative to said spindle axis which is less than the diameter of said center aperture of the rigid disk, said spindle means being oriented eccentrically within the inner diameter of said rigid disk, aid spindle means having a lubrication channel selectively coupled to a source of lubrication, said lubrication channel having an outlet orifice adapted to spray lubrication on said rigid disk from a position within said inner circumference of said rigid disk, drive means contacting said outer circumference of said rigid disk when said inner circumference is supported by said spindle means, said drive means being operative to rotate said rigid disk around a disk axis which is parallel to and spaced apart from said spindle axis, and first side finishing means selectively engaging a segment of said first side of said rigid disk, said first side finishing means extending from said outer circumference of said rigid disk to said inner circumference of said rigid disk.

19. A rigid disk finishing apparatus as recited in claim 18 wherein said drive means includes a drive sheave contacting said outer circumference of said rigid disk.

20. A rigid disk finishing apparatus as recited in claim 19 wherein said drive sheave is a first drive sheave, and further comprising a second drive sheave contacting said outer circumference of said rigid disk, wherein the axes of rotation of said first drive sheave, said second drive sheave, and said rigid disk are not copolanar.

21. A rigid disk finishing apparatus as recited in claim 18, wherein said first side finishing means includes a strip of flexible material having a width greater than the difference between said outer diameter and said inner diameter of said rigid disk.

22. A rigid disk finishing apparatus as recitdd in claim 21 further comprising means for drawing said strip past said rigid disk.

23. A rigid disk finishing apparatus as recited in claim 22 further comprising means for looping said strip against itself prior to contacting said rigid disk.

24. A rigid disk finishing apparatus as recited in claim 18 further comprising second side finishing means adapted to engage said second surface of said rigid disk, said second side finishing means extending from said outer circumference of said rigid disk to said inner circumference of said rigid disk.

* * * * *

UNITED STATES PATENT AND TRADEMARK OFFICE

CERTIFICATE OF CORRECTION

PATENT NO. : 4,671,018

DATED : June 9, 1987

INVENTOR(S) : Donald L. Ekhoff

It is certified that error appears in the above—identified patent and that said Letters Patent is hereby corrected as shown below:

Column 1, line 61, "across the rotating dish" should read - -across the rotating disk- -.

Column 3, line 40, "will discussed" should read - -will be discussed- -.

Column 3, line 66, "generally a 61." should read - -generally as 61.- -.

Column 5, line 62, "sheaves 20 an 22" should read - -sheaves 20 and 22- -.

Column 6, lines 50-51, "The end of shaft of 180" should read - -The end of shaft 180- -.

Column 8, line 3, "is then is deactivated" should read - -is then deactivated- -.

Column 8, line 13, "occur a first station 230," should read - -occur at first station 230,- -.

Claim 1, column 8, line 52, "said spindle axis saced apart" should read - -said spindle axis spaced apart- -.

Claim 8, column 9, line 25, "difference een said outer diameter" should read - -difference between said outer diameter- -.

Claim 13, column 9, line 45, "an inner circumferences" should read - -an inner circumference- -.

Claim 14, column 9, line 59, "arms, of which supports one" should read - -arms, each of which supports one- -.

UNITED STATES PATENT AND TRADEMARK OFFICE

CERTIFICATE OF CORRECTION

PATENT NO. : 4,671,018

DATED : June 9, 1987

INVENTOR(S) : Donald L. Ekhoff

It is certified that error appears in the above—identified patent and that said Letters Patent is hereby corrected as shown below:

Claim 16, column 10, lines 3-4, "said spindle said rigid disk" should read - -said spindle, said rigid disk- -.

Claim 18, column 10, line 38, "A disk fininshing apparatus" should read - -A disk finishing apparatus- -.

Claim 18, column 10, line 39, "an inner circumfernce" should read - -an inner circumference- -.

Claim 18, column 10, line 38 should end with "comprising,"; line 39 should be a subparagraph beginning - -a flat, annular, rigid disk- -.

Claim 18, column 10, line 49, "aid spindle means" should read - -said spindle means- -.

Claim 20, column 11, line 7, "are not copolanar" should read - -are not coplanar- -.

Signed and Sealed this

Twenty-second Day of March, 1988

*Attest:*

DONALD J. QUIGG

*Attesting Officer*

*Commissioner of Patents and Trademarks*